US005742114A

United States Patent [19]

Kohl et al.

[11] Patent Number: 5,742,114

[45] Date of Patent: Apr. 21, 1998

[54] LAMP ENVELOPE WITH A METAL CLAMPING MEMBER AND A FIXATION MEMBER

[75] Inventors: Hans J. Kohl; Ralf Schäfer, both of Aachen; Manfred Westemeyer, Aldenhoven, all of Germany; Cornelis J. Janson, Breda, Netherlands

[73] Assignee: U.S. Philips Corporation, New York, N.Y.

[21] Appl. No.: 642,011

[22] Filed: May 2, 1996

[30] Foreign Application Priority Data

May 3, 1995 [EP] European Pat. Off. ..... 95201150

[51] Int. Cl.[6] ..... H01J 5/48

[52] U.S. Cl. ..... 313/318.01; 313/318.09

[58] Field of Search ..... 313/318.01, 318.1, 313/318.02, 318.07, 318.06; 439/220, 221, 602, 375

[56] References Cited

U.S. PATENT DOCUMENTS

| | | | |
|---|---|---|---|
| 4,950,942 | 8/1990 | Braun et al. | 313/318.05 |
| 5,216,319 | 6/1993 | Van Heeswijk | 313/318 |
| 5,320,562 | 6/1994 | Moller et al. | 439/613 |
| 5,378,958 | 1/1995 | Van Heeswijk | 313/318 |
| 5,412,275 | 5/1995 | Dorsemagen et al. | 313/318 |
| 5,461,277 | 10/1995 | Van Gennip et al. | 313/331 |
| 5,479,066 | 12/1995 | Willems et al. | 313/318.05 |

*Primary Examiner*—Ashok Patel
*Assistant Examiner*—Vip Patel
*Attorney, Agent, or Firm*—Walter M. Egbert, III

[57] ABSTRACT

The capped electric lamp has a quartz glass lamp vessel (1) having first and second neck-shaped portions (2,3) with respective seals (4,5). A glass envelope (9) surrounds the lamp vessel and is secured thereto. A clamping member (20) surrounds the envelope in a clamping manner. A fixation member (32) of a lamp cap (30) is welded to the clamping member. The clamping member (20) is an undulated metal body, the crests of its creases constituting regions (22) which are spaced from the envelope (9) and in which welds to the fixation member (32) are made. Its troughs constitute clamping zones (21) which hold the envelope. The clamping member (20) allows for the application of a relatively wide envelope (9), which may enter the lamp cap (30).

20 Claims, 3 Drawing Sheets

LAMP ENVELOPE WITH A METAL CLAMPING MEMBER AND A FIXATION MEMBER

BACKGROUND OF THE INVENTION

The invention relates to a capped electric lamp comprising:

- a quartz glass lamp vessel which is closed in a vacuumtight manner and which has a mutually opposed first and second neck-shaped portion each with a seal through which a respective current conductor is passed to an electric element arranged in the lamp vessel;
- a glass envelope around the lamp vessel and fastened to the first neck-shaped portion thereof;
- a metal clamping member provided with a clamping zone with which it clamps around said envelope;
- a lamp cap provided with electric contacts and with a metal fixation member which is welded to the clamping member, the electric contacts being connected to respective current conductors;
- which clamping member comprises a welding zone which lies clear of the envelope and to which the fixation member is fixed by welding.

Such a capped electric lamp is known from U.S. Pat. No. 5,320,562. The lamp may be used as a vehicle headlamp, especially if the electric element is a pair of electrodes in an ionizable filling, but it may alternatively be used for other, for example optical applications. Said lamp has the advantage of a comparatively long life and a high luminous flux at a comparatively low power consumption of approximately 35 W. The light is generated between electrodes which are spaced apart no more than a few millimeters, for example 4.5 mm, so that the lamp has a very high luminance and the generated light can be very well concentrated into a beam by a reflector and possibly a lens. The lamp vessel has comparatively small internal dimensions of, for example, 1 to 3 mm diameter in the centre between the electrodes, and a length of approximately 4.5 to 9 mm.

The envelope around the lamp vessel has a constriction with which it is connected, for example fused, to the first neck-shaped portion of the lamp vessel. The envelope may also be connected to the second neck-shaped portion or it may have, for example, a constriction which grips around the current conductor issuing from the latter portion to the exterior.

The fixation member is welded to the clamping member after the electric element has been brought into a predetermined position relative to reference points of the lamp cap in that the lamp vessel is shifted, rotated, and/or tilted.

A metal clamping member around the envelope in the cited Patent document forms an alternative for the construction in which the clamping member bears directly on the relevant neck-shaped portion. This construction may be used in a lamp having an envelope such as, for example, known also from EP-A 0 570 068, EP-A 0 581 354, U.S. Pat. No. 5,461,277, and EP-A 0 579 326, U.S. Pat. No. 5,412,275, as well as in a lamp without envelope. The latter type of lamp is also known from, for example, U.S. Pat. NO. 5,216,319 and U.S. Pat. No. 5,378,958 and EP-A 0 579 313.

According to Patent Application EP 94 201 516.8 of earlier U.S. Pat. No. 5,677,589, in the lamp of the kind mentioned in the opening paragraph, a pinch is provided in the envelope, adjoining the constriction therein, on which pinch a clamping member bears by which the lamp vessel is held by the lamp cap.

U.S. Pat. No. 5,646,471 describes a lamp of the kind mentioned in the opening paragraph where a coating is provided on the envelope with which the occurrence of parasitic light in a beam formed by a reflector can be counteracted. A coating for that purpose having favorable properties as regards durability and high light absorption is described in U.S. Pat. No. 5,619,102.

U.S. Pat. No. 5,654,626 describes a lamp of the kind mentioned in the opening paragraph where a clamping member is provided on the envelope, narrowing up to the relevant neck-shaped portion, but remaining just clear thereof. A fixation member of the lamp cap grips the clamping member here in its narrow portion. The construction according to this Patent Application has the limitation that the envelope, given a certain distance from the electric element to the lamp cap, must be comparatively short to achieve that the narrowed portion of the clamping member is still accessible for making welded joints with the fixation member.

U.S. Pat. No. 5,541,471 describes a lamp of the kind mentioned in the opening paragraph where the envelope is formed from UV-absorbing quartz glass doped with cerium, titanium, europium, and aluminium.

Patent Application EP 95 20 11 07.0 describes a lamp of the kind mentioned in the opening paragraph where a pinch adjoins a seal of the lamp vessel at the area of an external current conductor. The external current conductor is welded to a metal foil which is embedded in the seal.

U.S. Pat. No. 5,479,066 discloses a capped electric lamp where a cylindrically flanged clamping plate is present on the lamp vessel, while a cylindrical fixation member with welding lugs is present in the lamp cap, said lugs being welded to the clamping plate. The fixation member has a scrape connection with the lamp cap.

The clamping member of the lamp described in the opening paragraph has a region, a welding zone, in which it makes no contact with the surrounded glass of the clamped-in envelope. It is prevented thereby that glass strain could arise owing to strong, highly localized heating when welded joints with the fixation member are being made in that region, which could lead to cracks or fractures. Such a clamping member is highly suitable for holding a glass component of small transverse dimensions, for example a few millimeters width and thickness, or a hollow glass component such as a tube, securely fixed.

The region clearing the clamped-in envelope of the clamping member of the lamp mentioned in the opening paragraph is a zone of the clamping member which adjoins the clamping zone in longitudinal direction of the lamp vessel, or which lies between two clamping zones in the longitudinal direction of the lamp vessel in an embodiment of the clamping member.

It is a limitation of this known clamping member that it is difficult to manufacture with the comparatively large dimension necessary for clamping in the comparatively wide envelope, compared with a clamping member designed for surrounding the comparatively narrow neck-shaped portion itself.

SUMMARY OF THE INVENTION

It is an object of the invention to provide a capped electric lamp of the kind described in the opening paragraph which has a construction which is reliable, simple, and easy to implement.

According to the invention, this object is achieved in that the clamping member has welding regions distributed over its circumference in the clamping zone, which regions clear the clamped-in envelope and in which regions the fixation member is fixed by welding.

The electric lamp is of a simple, effective, and reliable construction. The clamping member may also be readily realized, for example from metal strip. The clamping zone of the clamping member coincides at least substantially with the welding zone in which the welded joints with the fixation member are made, seen in longitudinal direction of the neck-shaped portion. The clamping member may accordingly be described as a cylinder with folds which run in its longitudinal direction. The troughs of the folds then together form the clamping zone, the crests of the folds together the welding zone. It is favorable here when the crests of the folds define a circular arc which is substantially concentric with the envelope. The lamp vessel may then be rotated together with the clamping member during lamp assembly for alignment without the distance to the fixation member being changed thereby. It is favorable for this purpose when the crests of the folds together enclose a circumferential angle of, for example, 100°–160°. The troughs of the folds preferably also lie on a circular arc so as to form a comparatively great contact surface area with the envelope, and thus to avoid a high local pressure on this envelope.

It is favorable when the clamping member is a bent metal strip with a pair of mutually opposed, laterally projecting welding tags which are welded to one another in order to close the strip into a cylindrical ring. In a special embodiment, the clamping member has a second pair of such welding tags, separated from the first pair in the direction of the first neck-shaped portion. More in particular, this embodiment has a pair of tags unconnected to one another between said two pairs of welding tags. The third pair may be used for bringing the tags to be welded into mutual opposition during closing of the cylindrical ring in that they are pulled towards one another with a tool. The force of the welding electrodes on the relevant welding tags may then be set to an optimum value for welding.

The clamping member may have one or several open hairpin-shaped loops, for example, in a cross-section in which welding tags are present. Such a loop may lie diametrically opposite a pair of welding tags. Favorable is one loop for each pair of welding tags. The clamping member may alternatively have, for each pair of welding tags, two loops in mutual opposition and, for example, symmetrically arranged relative to the welding tags. The loops contribute to the permanence of the clamping force in the case of thermal expansion owing to a raised temperature.

The fixation member may be a cylindrical body which is fixed in the lamp cap and which comprises welding lugs which are welded to the clamping member. The welding lugs may each have an outward bend for adapting it to the comparatively great diameter of the clamping member. Alternatively, however, the welding lugs may approach one another straight from a cylindrical body of comparatively great diameter.

The fixation member may have fixation tongues directed towards one another which keep the member fixed in the lamp cap, for example, clamped in. Alternatively, the fixation member may have toothed recesses which grip themselves behind respective projections in the lamp cap. It is also possible that it comprises both such fixation tongues directed towards one another and toothed recesses.

The electric element may be an incandescent body, in which case the lamp filling may comprise a halogen. Alternatively, however, the element may be a pair of electrodes, in which case the lamp has an ionizable filling, for example a filling of a rare gas such as, for example, xenon, for example at a pressure of several, for example 7 bar in the non-operational state, and one or several metal halides, possibly with mercury.

The envelope may be, for example, UV-absorbing and may be made, for example, from UV-absorbing quartz glass.

The contacts of the lamp cap may lie at the outside of the lamp cap so as to make connection with a connector or a lampholder. Alternatively, however, they may lie inside the lamp cap and be connected to a cable which issues from the lamp cap to the exterior.

BRIEF DESCRIPTION OF THE FIGURES

An embodiment of the capped electric lamp according to the invention is shown in the drawing, in which.

DESCRIPTION OF THE PREFERRED EMBODIMENTS

Figure 1:
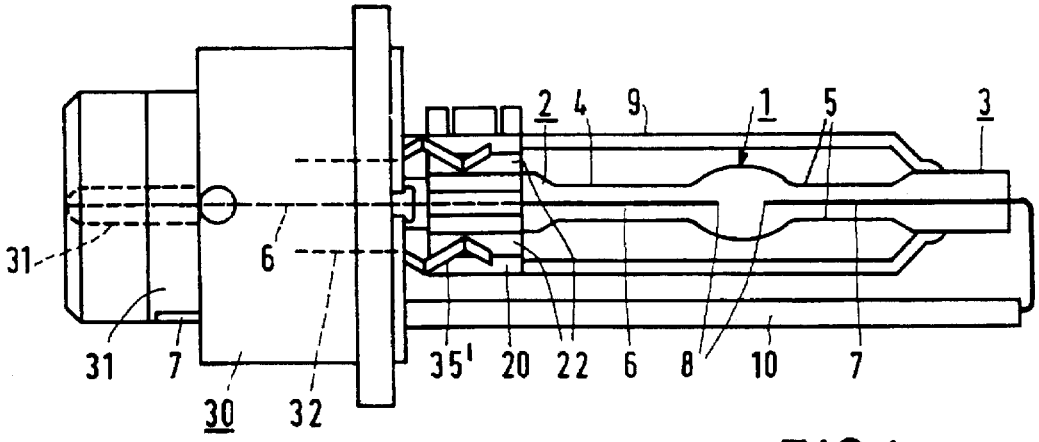
FIG. 1 shows the lamp in side elevation.
Figure 2:
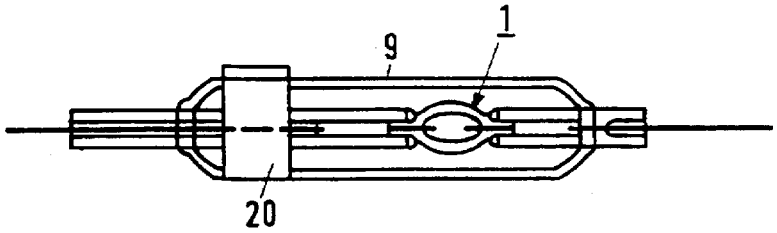
FIG. 2 shows the lamp vessel of FIG. 1 which is to be mounted in the lamp cap.

In FIG. 1, the capped electric lamp has a quartz glass lamp vessel 1 which is closed in a vacuumtight manner and which has a first neck-shaped portion 2 and, opposed thereto, a second neck-shaped portion 3 with seals 4, 5. Respective current conductors 6, 7 are passed through said seals to an electric element 8 arranged in the lamp vessel, in the Figure a pair of electrodes in an ionizable medium. The latter may comprise, for example, mercury, xenon and metal halides. A glass envelope 9 is present around the lamp vessel and fastened to the first neck-shaped portion thereof (FIG. 2). The envelope is fastened to the second neck-shaped portion 3 in the same manner in the lamp drawn. The current conductor 7 is surrounded by a ceramic pipe 10 which continuous into the lamp vessel for insulation laterally of the envelope 9.

Figure 3:
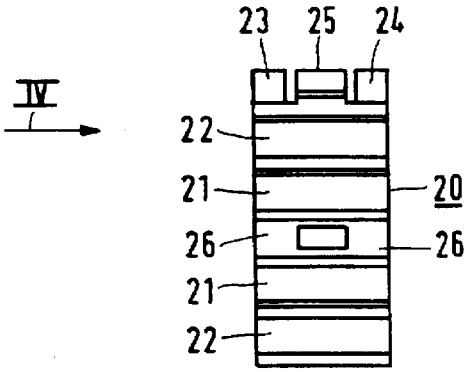
FIG. 3 shows the clamping member of FIGS. 1, 2 on an enlarged scale.
Figure 4:
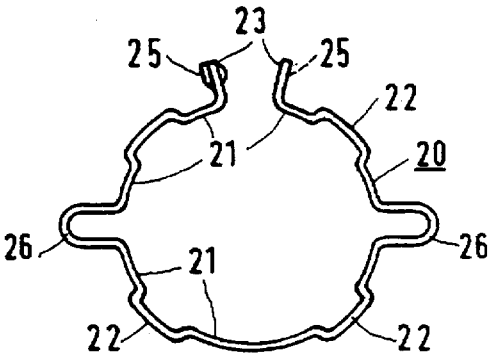
FIG. 4 shows the clamping member of FIG. 3 taken on the line IV.

A metal clamping member 20 having a clamping zone 21 (see FIGS. 3, 4) clamps with its clamping zone around the envelope. A lamp cap 30, for example made of synthetic resin, for example a thermoplastic synthetic resin such as, for example, polyether imide, provided with electric contacts 31 and a metal fixation member 32, is welded to the clamping member 20. Its electric contacts 31 are connected to respective current conductors 6, 7. The clamping member 20 has a welding zone 22 which clears the envelope 9 and to which the fixation member 32 is welded by means of welded joints made on lugs 35' thereof. In the Figure, the lugs 35' are bent in outward direction so as to give them the desired interspacing.

The clamping member 20 (see FIGS. 3, 4) has welding regions 22 distributed over its circumference in the clamping zone 21 which clear the clamped-in envelope 9 and in which the fixation member 32 is fixed by welding.

The construction of the lamp renders it possible for the envelope to be comparatively wide and yet continue into the lamp cap.

The clamping member 20 is a metal strip with folds which run in the direction of the first neck-shaped portion 2, the crests of the folds forming the welding regions 22. The strip has a pair 23 of mutually opposed, laterally extending welding tags which are welded to one another.

The clamping member 20 has a second pair 24 of welding tags separated from the pair 23 of welding tags seen in the direction of the first neck-shaped portion. This renders the coupling to the envelope very stable.

A pair of unconnected tags 25 is present between the pairs 23, 24 of welding tags, to which pair 25 a tool can be applied for forming the metal strip into a closed ring before the welding tags are welded together two-by-two.

The clamping member has an open hairpin-shaped loop 26 in cross-sections of the clamping member 20 taken through the welding tags. In the embodiment shown, the clamping member has two such loops in mutual opposition for each pair of welding tags, arranged symmetrically relative to said welding tags.

The welding regions 22 follow a circular arc, each with a circumferential angle of approximately 30°, so together approximately 120°, i.e. between 100° and 160°. The circular arcs are substantially concentric with the envelope. When the clamping member 20 is closed, the clamping zone 21 surrounds the envelope with clamping force, forming circular arcs of an inner circle. The welding regions 22 in that case lie in a circle concentric therewith.

Figure 5:
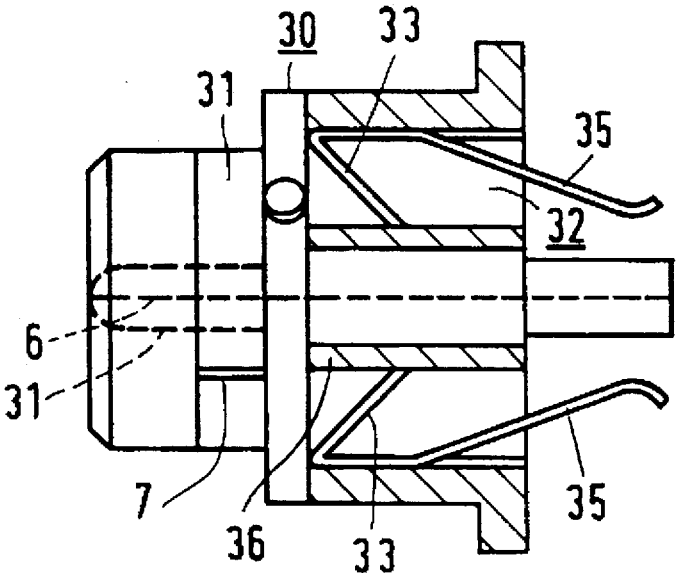
FIG. 5 shows the lamp cap of FIG. 1, partly in an axial sectional view, with its fixation member.

The fixation member 32 of FIG. 5 is a cylindrical body which comprises fixation tongues 33 which are directed towards one another and towards the lamp vessel 1 and which keep the fixation member secure in the lamp cap 30. The fixation tongues 33 have fixed themselves against the wall 36 of a central cavity through which current conductor 6 extends to the central pin contact 31 arranged in an open cavity. The welding lugs 35 extend straight towards one another and towards the clamping member in the finished lamp.

Figure 6:
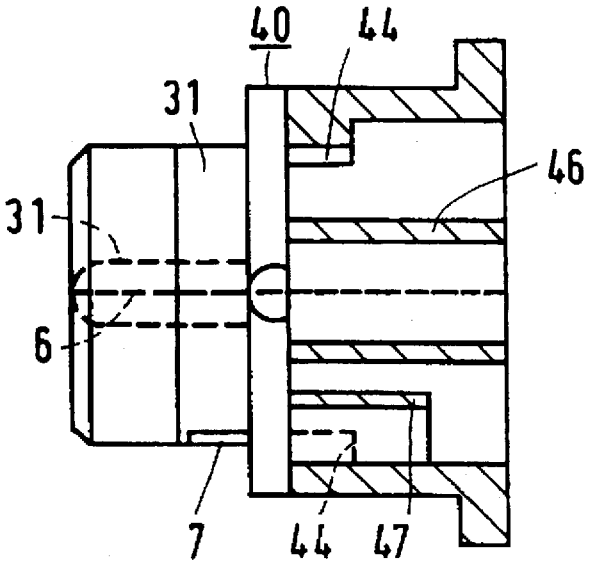
FIG. 6 shows an alternative embodiment of the lamp cap of FIG. 5.
Figure 7:
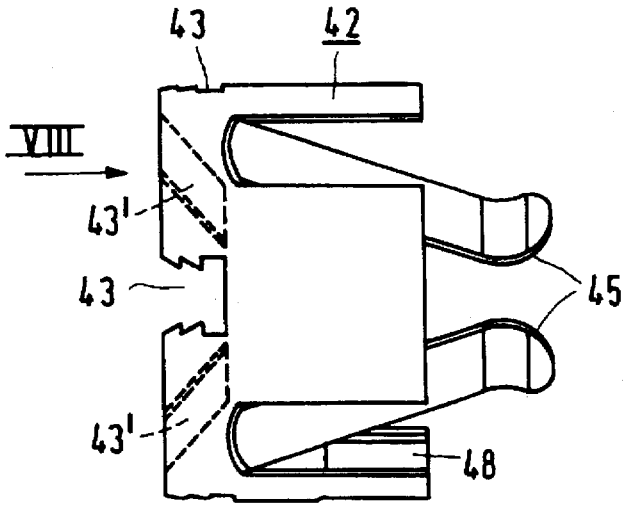
FIG. 7 shows the fixation member for the lamp cap of FIG. 6 in side elevation.
Figure 8:
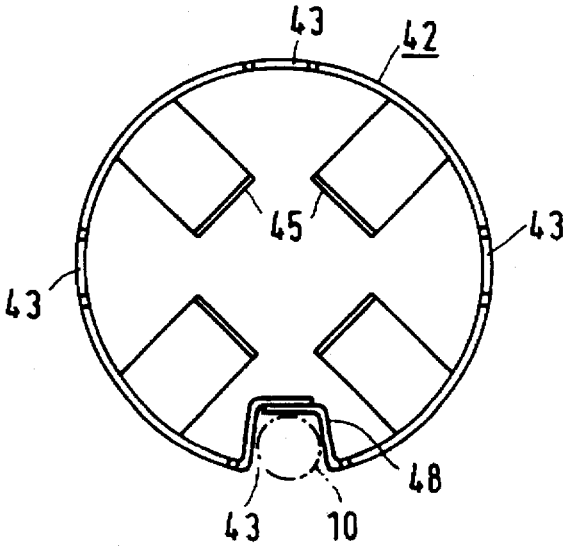
FIG. 8 shows the fixation member of FIG. 7 taken on the line VIII.

The lamp cap 40 in FIG. 6 has projections 44 against which toothed recesses 43 of the fixation member 42 of FIGS. 7, 8 can hold themselves in the lamp cap. The Figure shows a wall 46 around a central cavity and a wall 47 of a cavity through which current conductor 7, surrounded by the ceramic pipe 10 (FIG. 1), extends separately to the annular contact 31 at the outside of the lamp cap 40. One projection 44 is divided by the wall 47.

The fixation member 42 of FIGS. 7, 8 has toothed recesses 43 which can affix themselves to the projections 44 of the lamp cap of FIG. 6. The fixation member has a fold 48 for accommodating the ceramic pipe 10 of FIG. 1. The welding lugs 45 run straight towards one another and towards the clamping member in the mounted lamp.

FIG. 7 shows with broken lines a modification of the fixation member where this member also has fixation tongues 43' directed towards one another and towards the lamp to be held. This modification is not drawn in FIG. 8 because the fixation tongues in the elevation of this embodiment as shown will coincide substantially with the welding tongues 45.

We claim:

1. A capped electric lamp comprising:

a quartz glass lamp vessel which is closed in a vacuumtight manner and which has a mutually opposed first and second neck-shaped portion each with a seal through which a respective current condcutor is passed to an electric element arranged in the lamp vessel;

a glass envelope around the lamp vessel and fastened to the first neck-shaped portion thereof;

a metal clamping member provided with a clamping zone with which it clamps around said envelope;

a lamp cap provided with electric contacts and with a metal fixation member which is welded to the clamping member, the electric contacts being connected to respective current conductors;

said clamping member comprising a welding zone which lies clear of the envelope and to which the fixation member is fixed by welding;

wherein the clamping member has welding regions distributed over its circumference in the clamping zone, which regions clear the clamped-in envelope and in which regions the fixation member is fixed by welding.

2. A capped electric lamp as claimed in claim 1, wherein the clamping member is a metal strip with folds extending in the direction of the first neck-shaped portion, the crests of said folds forming the welding regions, while the clamping member has a pair of mutually opposed, transversely extending welding tags are welded together.

3. A capped electric lamp as claimed in claim 2, wherein the clamping member has a second pair of welding tags, separated from the first pair in the direction of the first neck-shaped portion.

4. A capped electric lamp as claimed in claim 3, wherein a pair of unconnected tags is present between the pairs of welding tags.

5. A capped electric lamp as claimed in claim 2, wherein an open hairpin-shaped loop is present in cross-sections of the clamping member taken through the welding tags.

6. A capped electric lamp as claimed in claim 1, wherein the welding regions lie on a circular arc which is substantially concentric with the envelope.

7. A capped electric lamp as claimed in claim 6, wherein the welding regions together cover a circumferential angle of 100° to 160°.

8. A capped electric lamp as claimed in claim 1, wherein the fixation member is a cylindrical body which comprises fixation tongues directed towards one another and towards the lamp vessel, which tongues keep the fixation members fixed in the lamp cap.

9. A capped electric lamp as claimed in claim 1, wherein the fixation member is a cylindrical body which has toothed recesses which keep themselves affixed to respective projections in the lamp cap.

10. A capped electric lamp as claimed in claim 9, wherein the fixation member also comprises fixation tongues which keep the fixation member fixed in the lamp cap.

11. A capped electric lamp as claimed in claim 8, wherein the fixation member has welding lugs which run straight towards the clamping member.

12. A capped electric lamp as claimed in claim 3, wherein an open hairpin-shaped loop is present in cross-sections of the clamping member taken through the welding tags.

13. A capped electric lamp as claimed in claim 4, wherein an open hairpin-shaped loop is present in cross-sections of the clamping member taken through the welding tags.

14. A capped electric lamp as claimed in claim 2, wherein the welding regions lie on a circular arc which is substantially concentric with the envelope.

15. A capped electric lamp as claimed in claim 14, wherein the welding regions together cover a circumferential angle of 100° to 160°.

16. A capped electric lamp as claimed in claim 2, wherein the fixation member is a cylindrical body which comprises fixation tongues directed towards one another and towards the lamp vessel, which tongues keep the fixation members fixed in the lamp cap.

17. A capped electric lamp as claimed in claim 2, wherein the fixation member is a cylindrical body which has toothed recesses which keep themselves affixed to respective projections in the lamp cap.

18. A capped electric lamp as claimed in claim 16, wherein the fixation member also comprises fixation tongues which keep the fixation member fixed in the lamp cap.

19. A capped electric lamp as claimed in claim 9, wherein the fixation member has welding lugs which run straight towards the clamping member.

20. A capped electric lamp as claimed in claim 10, wherein the fixation member has welding lugs which run straight towards the clamping member.

* * * * *